United States Patent [19]

Kitamura et al.

[11] 4,061,559

[45] Dec. 6, 1977

[54] ELECTROLYTIC CELL AND CIRCULATING METHOD FOR ELECTROLYTE

[75] Inventors: Tatsuzo Kitamura, Yokohama; Haruji Inaba, Hachiohji, both of Japan

[73] Assignee: Mitsui Mining & Smelting Co., Ltd., Nihonbashi-Muromachi, Japan

[21] Appl. No.: 679,859

[22] Filed: Apr. 23, 1976

[30] Foreign Application Priority Data

Sept. 11, 1975 Japan ..... 50-110368

[51] Int. Cl.[2] ..... C25C 1/12; C25C 7/00; C25C 7/06

[52] U.S. Cl. ..... 204/106; 204/237

[58] Field of Search ..... 204/237–239, 204/106–108

[56] References Cited

U.S. PATENT DOCUMENTS

| | | | |
|---|---|---|---|
| 535,802 | 3/1895 | Lugo | 204/152 |
| 3,324,023 | 6/1967 | Kircheo | 204/256 |
| 3,657,097 | 4/1972 | Baldock et al. | 204/202 |
| 3,692,647 | 9/1972 | Chambers et al. | 204/105 R |
| 3,766,044 | 10/1973 | Westerlund | 204/268 |
| 3,836,443 | 9/1974 | MacGregor | 204/105 M |
| 3,966,567 | 6/1976 | Pace et al. | 204/105 R |

*Primary Examiner*—F.C. Edmundson

[57] ABSTRACT

An electrolytic cell of high capacity and circulation for the electrolytic refining and recovery of copper at a high current density is described, comprising a pair of supply ports and a single discharge port for supply and discharge of an electrolyte. The electrolyte which is first divided into two portions and supplied from the supply ports is circulated through individual zones of the internal space of the cell uniformly along the longest path at a low linear velocity and is finally discharged from a common discharge port.

5 Claims, 5 Drawing Figures

ELECTROLYTIC CELL AND CIRCULATING METHOD FOR ELECTROLYTE

BACKGROUND OF THE INVENTION

In the electrolytic refining and recovery of copper in an electrolytic cell using a suitable electrolyte, it is desirable to circulate the electrolyte through the internal space of the electrolytic cell in order to accelerate migration toward the cathode of copper ions in the electrolyte as a result of electrolysis and to carry out the electrolysis efficiently while maintaining uniformly the copper ion concentration in the electrolyte and maintaining constantly the temperature of the electrolyte.

In this process a current density in the order of 250 $A/m^2$ has been considered to be an upper limit, due to the fact that the anode tends to be passivated and the effect of deposition of the metal on the cathode tends to be deteriorated when the current density exceeds the above limit. However, with the development of thyristors, it has become possible to easily control the flow of a large current and reverse the direction of such current flow. A so-called PRC (Periodic Reverse Current) method utilizing thyristors has been proposed in this field in which the direction of flow of a large current is periodically reversed. This PRC method is effective and advantageous among others as the current density in the electrolytic refining of copper can be greatly increased to improve productivity; the unit construction cost is relatively low; and the labor cost can also be reduced, although it has the drawback that the electrical power requirement is increased.

Thus, there are various problems to be solved for the successful production of highly pure copper by electrolysis at high current density utilizing the PRC method. To solve one of these problems, it is necessary to increase the amount of circulating electrolyte to a value greater than that circulated hitherto in order that the electrolytic refining at high current density can be successfully carried out.

In the electrolytic refining of copper according to conventional methods in an electrolytic cell, the amount of the circulating electrolyte is generally 20 to 25 l/min. However, an amount considerably greater than this value must be supplied to the electrolytic cell when the electrolytic refining of copper is carried out according to the PRC method. Insoluble impurities precipitate or settle as slime on the bottom of the electrolytic cell when the copper anode is progressively dissolved into the electrolyte as the electrolysis proceeds.

In order that electrolytic copper of good quality or high purity can be consistently produced by electrolysis with high current density obtained by the PRC method, it is essentially required to increase the circulating amount of the electrolyte without giving rise to undesirable floating movement of the slime settled on the bottom of the electrolytic cell. Meanwhile, an enlargement in the capacity of the electrolytic cell is also demanded together with the increase in the current density, and a novel method for circulating the electrolyte is demanded to deal with the increase in both the cell capacity and current density.

There are various methods for circulating electrolyte through an electrolytic cell used for the electrolytic refining of copper. According to the method conventionally employed in the art, the electrolyte is supplied from one side of the electrolytic cell and discharged from the other or opposite side of the cell. This method may be further classified into a plurality of methods. According to one of these methods, a supply port and a discharge port are provided respectively in the middle of the confronting side walls of the electrolytic cell for supply and discharge of the electrolyte into and out of the cell. In another method, a supply port and a discharge port are provided respectively at the diagonally opposite corners of the electrolytic cell for supply and discharge of the electrolyte into and out of the cell. However, these methods are undesirable in electrolysis at high current density which results in degrading the quality of electrolytic copper produced and reducing the rate of recovery of noble metals such as gold and silver. This is because such attempts to increase the amount of the circulating electrolyte results in undesirable floating of the slime settled on the bottom of the cell and suspension of the slime in the electrolyte. Further, when the capacity of the electrolytic cell is enlarged and the current density used for the electrolysis is also increased withough increasing the amount of the circulating electroyte, the concentration of copper in the upper layer of the internal space of the electrolytic cell differs greatly from that in the lower layer in the internal space of the cell, and the copper concentration in the lower layer becomes higher than that in the upper layer by about 7 to 8 g/l, due to the fact that the amount of the circulating electrolyte is insufficient compared with the cell capacity. On the other hand, a situation reverse to that of the copper concentration distribution occurs in the concentration distribution of free sulfuric acid. Consequently, the anode is frequently non-uniformly dissolved and this phenomenon makes impossible further continuation of electrolysis in the so-called passivated state due to non-uniform dissolution. This tendency becomes more predominant with increase in the current density, and finally, the electrolysis with increased current density will become impossible. The essential conditions required for successful production of electrolytic copper of good quality or high purity with an electrolytic cell of large capacity and high current density using a circulating electrolyte include:

1. capability of supplying sufficient copper ions and additives to the cathode surface;
2. minimization of fluctuation in the concentration of the electrolyte in the cell;
3. minimization of fluctuation in the temperature of the electrolyte in the cell; and
4. elimination of floating or suspension of slime in the electrolyte caused by the circulating flow;

Applicants have succeeded in developing a highly efficient electrolytic cell of large capacity which satisfies the above conditions and which is capable of stable operation with high current density for the electrolytic production of highly pure copper.

BRIEF SUMMARY OF INVENTION

It is a primary object of the present invention to provide a novel and improved electrolytic cell and method for circulating an electrolyte for the electrolytic refining and recovery of copper by circulating substantially large quantities of an electrolyte, in which a common discharge port is provided at a lower (or upper) central part of one of the longer side walls of the cell, and a pair of supply ports are provided at upper (or lower) corners of the other longer side walls of the cell, each being adapted to supply the electrolyte in an amount of about one half the total supply required, so that a substantial quantity of electrolyte can be uniformly supplied while maintaining the linear velocity of the electrolyte in the electrolytic cell as low as possible, and highly pure copper can be electrolytically produced with minimum difficulties and reliable operation of the electrolytic cell.

DETAILED DESCRIPTION OF INVENTION

A novel and improved electrolytic cell of rectangular cross section according to the present invention comprises a pair of supply ports for supplying portions of electrolyte, each of which corresponds substantially to a half of the required amount, and a single of common discharge port for discharging the electrolyte, so that these electrolyte portions can be uniformly circulated through the cell while maintaining the linear velocity thereof in the cell as low as possible. More precisely, the electrolytic cell is substantially divided into two sections or zones which are analogous to cubes substantially congruent with each other, and the supply ports are arranged to supply each previously divided electrolyte portions in a diagonal direction with respect to the respective cubes. These diagonal streams of electrolyte join with each other on one end of the vertical centerline of the longer side walls of the cell, and the common discharge port is disposed at the junction point of the diagonal streams on a side wall of the cell. The two supply ports are thus respectively disposed so that the source of each stream of electrolyte eminates from the opposite ends of the longer side wals of the cell. In this manner a large quantity of the electrolyte can be uniformly circulated through the electrolytic cell while maintaining the linear velocity as low as possible, due to the fact that the divided portions of electrolyte which are supplied from each support port need not circulate through the entire internal space of the cell but merely circulate through the bisected zone of the internal space to the discharge port.

The diagonal streams of electrolyte established by pumping electrolyte through both inlet ports and pumping it out of the discharge port at suitable rates to maintain uniform flow from the inlet ports to the discharge port without overloading the cell with electrolyte or depleting the same of electrolyte. To attain the objects of the invention, it is necessary to circulate enough electrolyte and to maintain the concentration of $Cu^{++}$ ions and free $H_2SO_4$ uniformly at the vicinity of the electrodes with minimum flotation of any slime resulting from the electrolysis. The electrodes are placed in the cell in a conventional manner, as illustrated for example in FIG. 5, the electrolyte being circulated about the same and through the cell as herein described.

Figure 1:
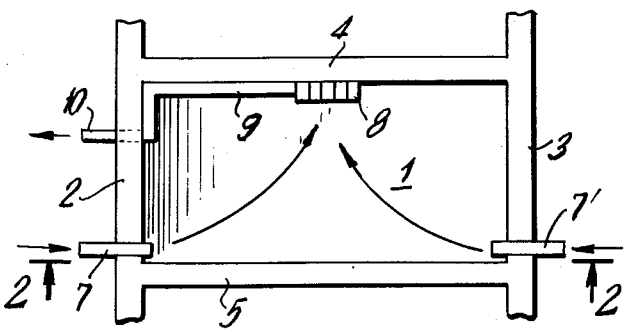
FIG. 1 is a schematic top plan view of one embodiment of an electrolytic cell according to the present invention, discharge port 8 being located in the upper portion of the cell.
Figure 2:
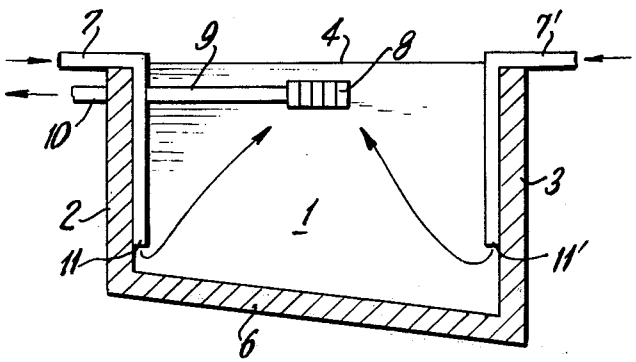
FIG. 2 is a schematic sectional view in elevation of the cell shown in FIG. 1, along line 2—2 of FIG. 1.

In a first embodiment of the present invention, the electrolyte is supplied from a lower part of each of the corners formed by one of the longer side walls and the adjoining shorter side walls and discharged from an upper central part of the other or opposite longer side wall as shown in FIGS. 1 and 2.

Figure 3:
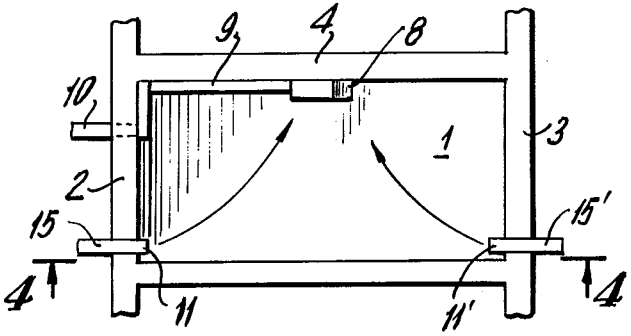
FIG. 3 is a schematic top plan in view of another embodiment pf the present invention, discharge port 8 being located in the lower portion of the cell.
Figure 4:
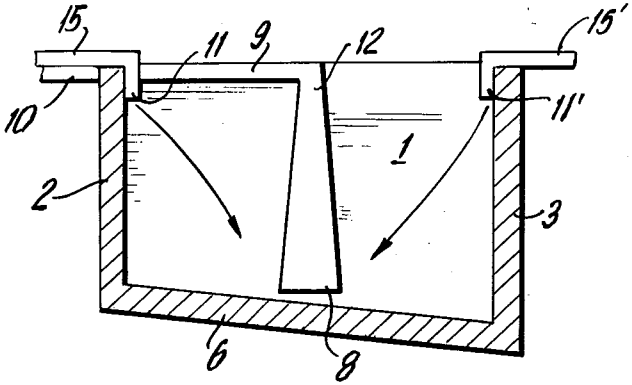
FIG. 4 is a schematic sectional view in elevation of the cell shown in FIG. 3, along line 4—4 of FIG. 3.

In a second embodiment of the present invention, the electrolyte is supplied from an upper part of each of the corners formed by one of the longer side walls and the adjoining shorter side walls and discharged from a lower central part of the other or opposite longer side wall as shown in FIGS. 3 and 4. In the first embodiment, the electrolyte is directed from supply ports 7 and 7′ diagonally through the cell to discharge port 8, and in the second embodiment from supply ports 15 and 15′ to discharge port 8. While these two embodiments are both effective in obtaining the principal object of the present invention, supplying the electrolyte from the upper ports and directing the same to a lower discharge port is preferred to supplying the electrolyte from lower ports to an upper discharge port. When the electrolyte is supplied through upper ports and discharged through a lower port, products of better quality generally are obtained when the electrolysis is carried out at high current density.

Without limiting the invention to any theory, it is believed that the direction of flow of the electrolyte should be the same as the direction of the precipitation of settling slime and therefore, there is less tendency to cause objectionable dispersion of the slime. Secondly, the slime can easily settle on the bottom of the electrolytic cell since there is less tendency to produce a high copper concentration layer in the lower zone of the internal space of the cell. Thirdly, the electrolyte supplied from the upper part of the electrolytic cell encounters less resistance against flow, thereby insuring sufficient supply of the electrolyte and additives to the electrodes.

Bubbles tend to be included in the circulating electrolyte during electrolysis. These bubbles obstruct the desired electrolytic refining when the elecrolyte is supplied from a lower level and discharged at an upper level, since the bubbles attach to the slime, and the slime adhered to the surface of the bubbles will often rise to the surface of the electrolyte. The introduction of electrolyte at the upper portion of the cell and discharge at a lower portion is also advantageous in that any such bubbles which form can more readily be stripped to the atmosphere.

The present invention will now be more specifically described with reference to the drawings and the following examples:

EXAMPLE 1

FIGS. 1 and 2 show a schematic top plan view and a schematic elevational view in section respectively, showing an application of the electrolytic cell of the present invention to the electrolytic refining of copper.

Figure 5:
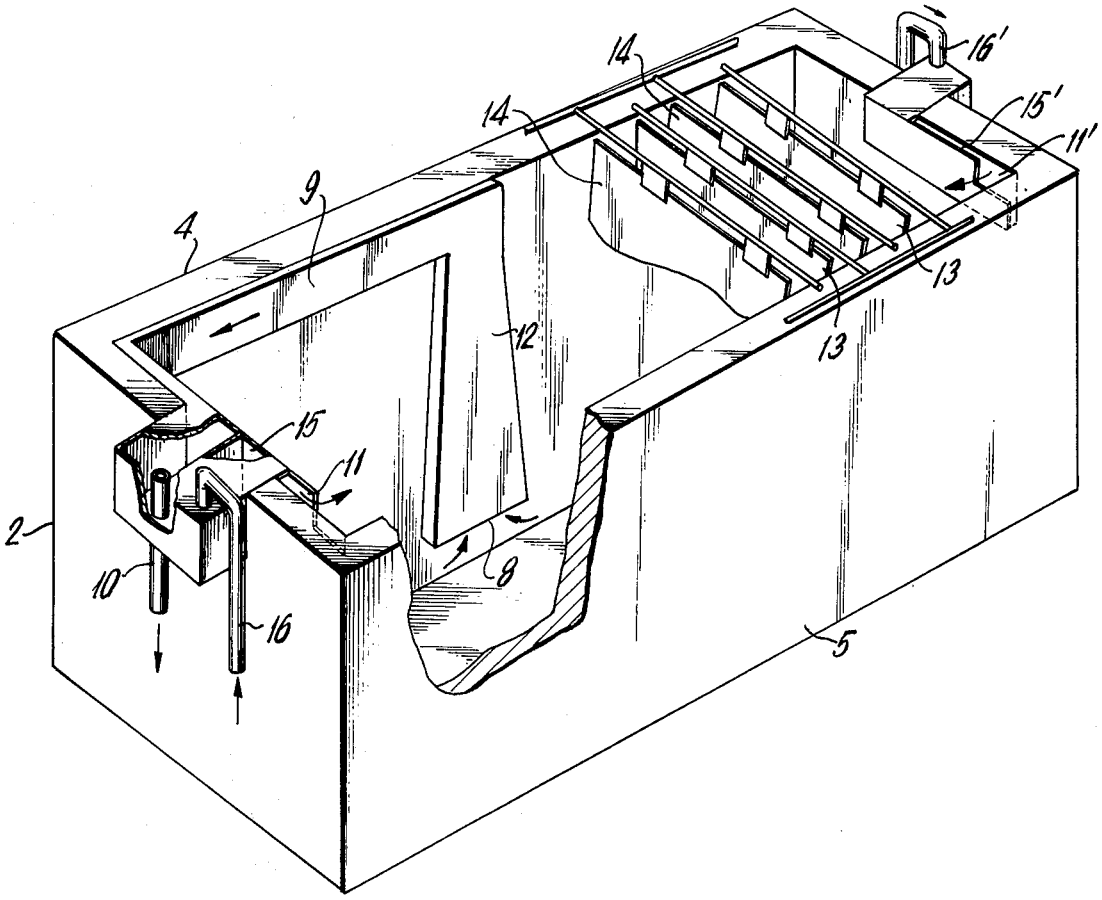
FIG. 5 is a perspective view with a broken section of another embodiment of the present invention.

Referring to FIGS. 1 and 2, the electrolytic cell according to the present invention is generally designated by the reference numeral 1 and comprises a pair of shorter side walls 2, 3, a pair of longer side walls 4, 5, and a bottom wall 6. A pipe 7 for supplying an electrolyte extends downwardly from an upper part of the cell 1 into the internal space along the corner formed by the side wall 2 and adjoining side wall 5, and the lower ene of the electrolyte supply pipe 7 terminates at a suitable level above the bottom wall 6 to provide an electrolyte supply port 11. Another pipe 7′ similar to the pipe 7 extends similarly downwardly from an upper part of the cell 1 into the internal space along the corner formed by the side wall 3 and adjoining side wall 5, and the lower end of the pipe' terminates at a suitable level above the bottom wall 6 to provide another electrolyte supply port 11'. An electrolyte discharge pipe 10 extends through the upper part of the side wall 2 to be connected to one end of a trough 9 extending horizontally along the inner surface of the side walls 2 and 4. The other end of this trough 9 terminates in the middle of the inner surface of the side wall 4 to provide an electrolyte discharge port 8. The anodes and cathodes are not shown in FIGS. 1 and 2. Although in actual operation as many as 46 sheets of anodes and 45 sheets of cathodes may be inserted in the cell and therein arranged alternately, a lesser number is shown in FIG. 5 for illustrative purposes.

The electrolyte heated up to a predetermined temperature is supplied from the electrolyte supply ports 11 and 11' through the respective supply pipes 7 and 7' disposed along the adjacent corners of the electrolytic cell 1, and the electrolyte, having circulated through the cell 1, is discharged from the discharge port 8 prepared at the middle of the side wall 4. The electrolyte flows through the trough 9 to be discharged to the exterior of the cell by way of the discharge pipe 10.

It will be understood from the above description that the electrolytic cell in this embodiment of the present invention comprises a pair of electrolyte supply ports for supplying electrolyte upwardly along a path corresponding to the diagonal of a cube before the electrolyte is finally discharged from the cell. Therefore, the amount of the circulating electrolyte can be easily increased to two or three times that supplied hitherto, and yet, the tendency of giving rise to non-uniform concentration distribution of the electrolyte in the upper and lower layers of the cell can be minimized. Thus, an electrolytic cell of large capacity can be operated satisfactorily and reliably at a high current density.

The operating performance of the electrolytic cell according to the above first embodiment of the present invention was compared with that of a hitherto used electrolytic cell of the type supplying an electrolyte from one side and discharging from the other side. Both of these cells had the same internal dimensions of 5,350 mm × 1,200 mm × 1,300 mm and were used for the electrolytic refining of copper with the same current density. The conditions employed for the electrolysis were as follows:

Electrode
spacing: center-to-center: 100 mm
Anode size: 980 mm × 960 mm × 40 mm
Cathode size: 1,000 mm × 1,000 mm × 0.7 mm
Number of anodes subjected to test: 46 per cell
Current density: 320 A/m²
Copper concentration: 42g/l
Free sulfuric acid concentration: 180g/l
Temperature of electrolyte: 63° C ± 1° C The results of this test are shown in Table 1.

Table 1

| | Prior Art | Present Invention |
|---|---|---|
| Amount of circulating electrolyte | 20 l/min | 40 l/min |
| Copper concentration dispersion | 7–8 g/l | 2–3 g/l |
| Electrolyte temperature Dispersion | 2.5–3.0° C | 0.7–1.5° C |
| Current efficiency | 90% | 95% |

In Table 1, the copper concentration dispersion and electrolyte temperature dispersion represent the difference between the values measured at the levels of 100 cm and 5 cm beneath the electrolyte surface level. (The same applies to the following description.)

EXAMPLE 2

FIG. 3 is a schematic plan view of another and preferred electrolytic cell according to the present invention. FIG. 4 is a schematic vertical sectional view along line 4—4 of FIG. 3 and FIG. 5 is a perspective view of a more specific preferred embodiment of the invention. The electrolytic cell shown in FIGS. 3, 4 and 5 are substantially similar in shape and construction to that shown in FIGS. 1 and 2. However, this electrolytic cell differs from the cell described in Example 1 in that the electrolyte supply conduits or troughs 15 and 15' are connected to the supply ports 11 and 11' which are arranged to supply the electrolyte downwardly from an upper part of the electrolytic cell 1. Supply troughs 15 and 15' are fed by inlets 16 and 16' respectively. This electrolytic cell differs further from example 1 in that the trough 9, connected at one end thereof to the electrolyte discharge pipe 10 extends through the side wall 2, and further extends horizontally along the inner surface of side walls 2 and 4 to about the center of side wall 4 and then downwardly as a discharge conduit 12 along substantially the center line of side wall 4, terminating at a little above the bottom wall 6 to provide a discharge port 8. In this example the electrolyte discharge port 8 is thus disposd at a lower position. Therefore, the divided portions of electrolyte supplied from the supply ports 11 and 11' flow downwardly along a path corresponding to the diagonal of a cube and are finally discharged from the discharge port 8, and the direction of electrolyte flow is not upwardly as in Example 1. The trough 9 may extend through the bottom wall 6 of the electrolyte cell 1 instead of being guided along the inner surface of the walls 2, 4 and 6.

FIG. 5 shows a preferred commercial form of the invention wherein two anodes 13 and two cathodes 14 are shown merely for illustrative purposes, the number of each actually employed being significantly larger.

The operating performance of the example shown in FIGS. 3, 4 and 5 was compared with that of Example 1 shown in FIGS. 1 and 2. Both of these electrolytic cells had the same internal dimensions of 4,860 mm × 1,200 mm × 1,250 mm and were used for the electrolytic refining of copper. In this test, the current density was selected to be higher than that in the test carried out in Example 1. The conditions employed for the electrolysis are as follows:

Electrode
spacing: center-to-center: 100 mm
Anode size: 980 mm × 960 mm × 40 mm
Cathode size: 1,000 mm × 1,000 mm × 0.7 mm
Number of anodes subjected to test: 46 per cell
Current density: 340 A/m²
Copper concentration: 40–45 g/l
Free sulfuric acid concentration: 185–195 g/l
Temperature of electrolyte: 64° C
Amount of circulating electrolyte: 40 l/min The results of this test are shown in Table 2.

Table 2

| | | supplying lower part of cell and discharging above | | supplying upper part of cell and discharging below | |
|---|---|---|---|---|---|
| | | copper concentration g/l | Electrolyte temp. °C | Copper concentration g/l | Electrolyte temp. °C |
| Supplied electrolyte | | 41.0 | 64.8 | 41.0 | 64.8 |
| Discharged electrolyte | | 41.3 | 63.9 | 41.4 | 63.8 |
| Measured level beneath electrolyte surface level | 5cm | 42.0 | 63.9 | 37.8 | 63.7 |
| | 50cm | 44.1 | 64.0 | 39.0 | 64.0 |
| | 100cm | 46.1 | 65.0 | 41.2 | 64.2 |
| Dispersion | | 4.1 | 1.1 | 3.4 | 0.5 |
| Current efficiency | | 95.0% | | 95.8% | |

It will be seen from Table 2 that the copper concentration dispersion and electrolyte temperature dispersion in the case of supplying electrolyte from the upper part of the cell and discharging the same from the lower part are less than in the case of supplying electrolyte from the lower part and discharging the same from the upper part. Therefore, the current efficiency is improved correspondingly. Such improved current efficiency can be obtained due to the fact that no dispersion of slime occurs and the tendency of deposition of nodularized copper is reduced.

In the embodiment wherein electrolyte is supplied from the lower part of the cell and discharged from the upper part of the cell, Table 2 shows that the value of the copper concentration dispersion is greater than that shown in Table 1. This is believed to be caused by higher current density than that used in the test carried out to compare the operating performance of supplying electrolyte at lower portions and discharging at upper portions with that of the hitherto used cell.

It has thus been demonstrated that the circulating method of the present invention can be effectively used to produce electrolytic copper of good quality, and having less nodularized copper on the surface of the product compared with that produced by hitherto known cells of the type described.

What we claim is:

1. A method of circulating an electrolyte in the electrolytic refining of copper in which plates of pure copper are electrodeposited on a cathode surface and anode plates of crude copper are dissolved in the electrolyte while using a current density of more than 250 A/m², comprising the following steps:

A. dividing the circulating electrolyte into two supply streams of substantially equal volume and flow rate;

B. introducing each stream to a cell of substantially rectangular cross section at a flow rate of more than 15 l/min. from opposed corners of a longer side wall of the cell, said flow rate being such as to minimize flotation of resulting slime and copper concentration dispersion; and C. discharging the electrolyte at a flow rate of more than 30 l/min. from a discharge port situated at a central part on the inner surface of the opposed longer side wall thereof.

2. A method according to claim 1, wherein the supply streams are introduced at the upper part of the cell and the electrolyte is discharged at the lower part thereof.

3. A method according to claim 2, wherein the electrolysis is conducted at a current density of from 300 A/m² to 400 A/m² and the flow rate of the circulating electrolyte at the discharge port is more than 40 l/min.

4. A method according to claim 1, wherein the supply streams are introduced at the lower part of the cell and the electrolyte is discharge at the upper part thereof.

5. A method according to claim 4, wherein the electrolysis is conducted at a current density of from 300 A/m² to 400 A/m² and the flow rate of the circulating electrolyte at the discharge port is more than 40 l/min.

* * * * *